United States Patent [19]

Pokladnik

[11] 4,439,068

[45] Mar. 27, 1984

[54] RELEASABLE GUIDE POST MOUNT AND METHOD FOR RECOVERING GUIDE POSTS BY REMOTE OPERATIONS

[75] Inventor: Roger L. Pokladnik, Houston, Tex.

[73] Assignee: Armco Inc., Middletown, Ohio

[21] Appl. No.: 422,091

[22] Filed: Sep. 23, 1982

[51] Int. Cl.[3] ..... E02B 7/12; F16L 35/00

[52] U.S. Cl. ..... 405/169; 405/168; 405/188; 166/338; 285/24; 285/315

[58] Field of Search ..... 405/169, 170; 166/338, 166/349, 340; 285/27, 315, 316

[56] References Cited

U.S. PATENT DOCUMENTS

| | | | |
|---|---|---|---|
| 1,443,455 | 1/1923 | Bown . | |
| 1,509,651 | 9/1924 | Iftiger | 285/315 |
| 3,050,140 | 8/1962 | Hayes | 166/349 |
| 3,163,220 | 12/1964 | Haeber et al. | 166/46 |
| 3,186,745 | 6/1965 | Lyles | 287/119 |
| 3,321,015 | 5/1967 | Word, Jr. | 166/0.5 |
| 3,492,027 | 1/1970 | Herring | 166/340 |
| 3,553,821 | 1/1971 | Postlewaite | 29/427 |
| 3,603,386 | 9/1971 | Talley, Jr. | 166/0.5 |
| 3,628,812 | 12/1971 | Larralde et al. | 285/315 |
| 3,678,996 | 7/1972 | Herd | 166/0.5 |
| 3,695,350 | 10/1972 | Petersen | 405/169 |
| 3,695,633 | 10/1972 | Hanes | 166/340 |
| 3,946,805 | 3/1976 | Peterman | 166/0.6 |
| 4,004,635 | 1/1977 | Marquaire et al. | 405/169 |
| 4,120,362 | 10/1978 | Chateau et al. | 166/339 |
| 4,194,857 | 3/1980 | Chateau et al. | 405/203 |

*Primary Examiner*—Dennis L. Taylor

*Attorney, Agent, or Firm*—Roylance, Abrams, Berdo & Goodman

[57] ABSTRACT

An apparatus for releasably supporting a guide post to an underwater well installation and a method for recovering such a guide post by remote operation from the surface. The apparatus comprises a support sleeve coupled to the well installation and receiving a lower end portion of the guide post therein, an outer actuating sleeve movably supported on the support sleeve, and a plurality of locking elements coupled to the support sleeve and moved radially inwardly into engagement with the guide post by means of the actuating sleeve. The locking elements have ring segments engageable by the actuating sleeve and radially inwardly directed pins which pass through bores in the support sleeve and are received in a locking groove in the guide post lower end portion. The guide post is recoverable by a remotely lowered and operated tool that has a first pair of jaws for engaging and lifting the actuating sleeve, thereby unlocking the guide post, and a second pair of jaws for engaging and retrieving the unlocked guide post to the surface.

10 Claims, 7 Drawing Figures

FIG. 4
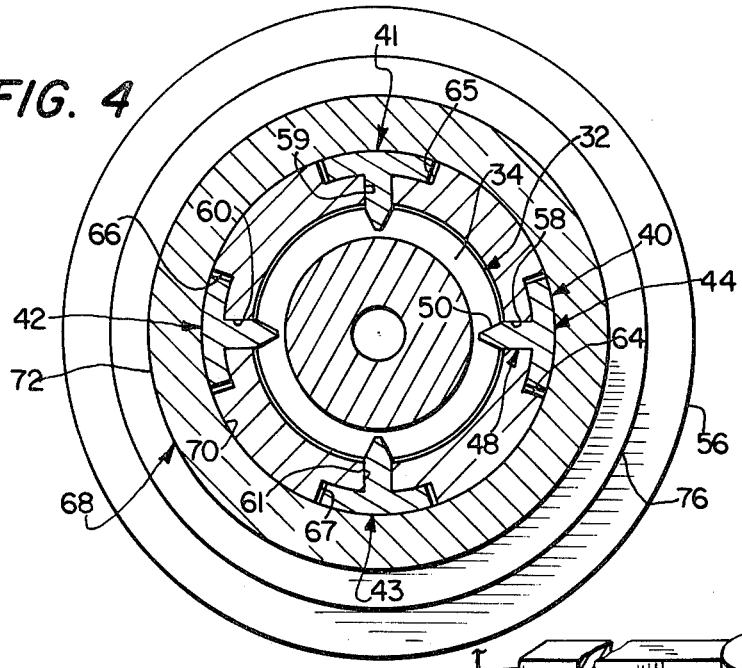
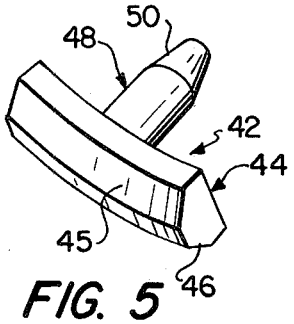
FIG. 5
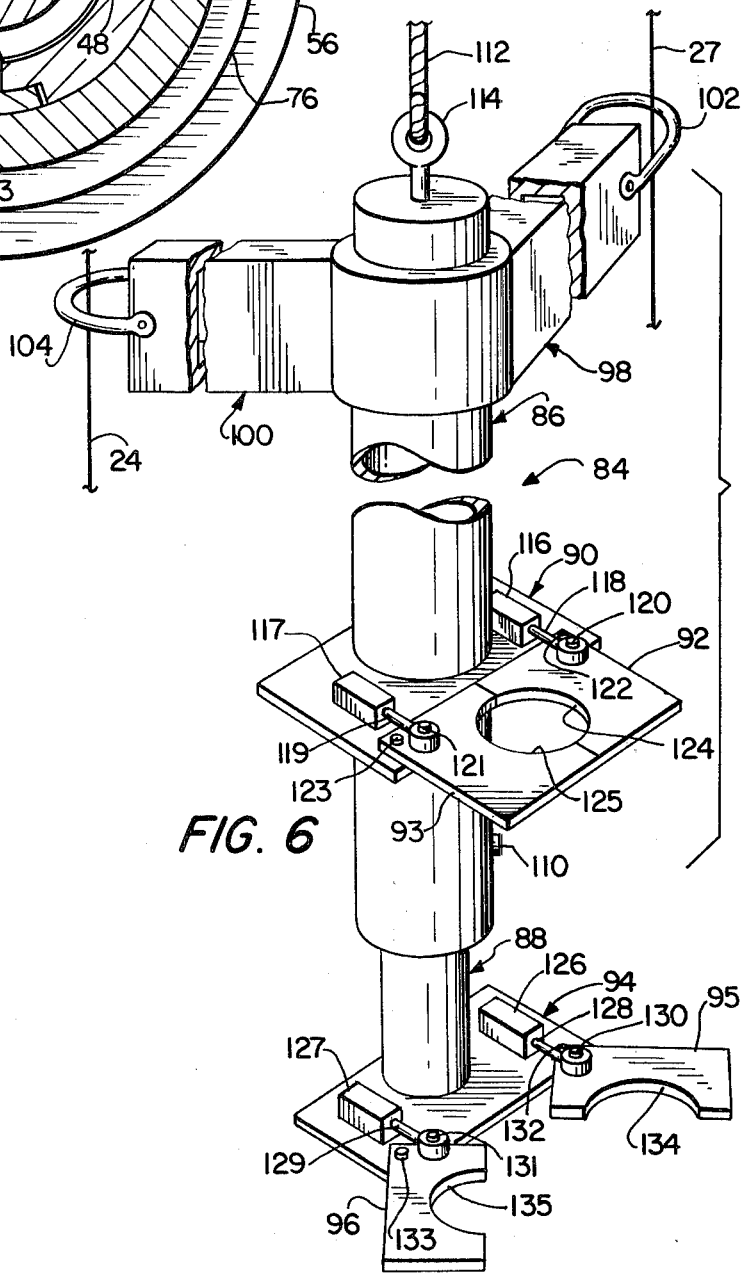
FIG. 6
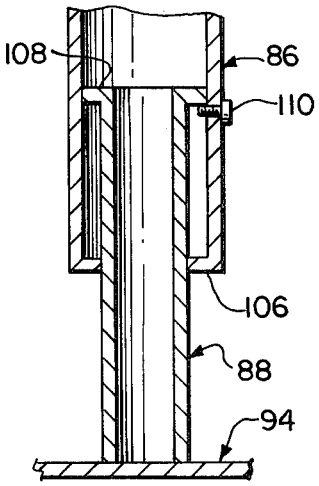
FIG. 7

RELEASABLE GUIDE POST MOUNT AND METHOD FOR RECOVERING GUIDE POSTS BY REMOTE OPERATIONS

RELATED APPLICATIONS

Copending application Ser. No. 422,092, filed concurrently herewith by Roger L. Pokladnik, for Laterally Releasable Connection Between Wellhead and Template, discloses and claims the manner in which the template shown in this application is secured to the suspension joint.

FIELD OF THE INVENTION

This invention relates to a device for releasably securing guide posts to an underwater template or other guide means base and to a method for recovering guide posts from an underwater well installation by operations carried out from the surface of the body of water.

BACKGROUND OF THE INVENTION

In underwater well installations, a template or guide means base typically supports a plurality of vertical guide posts having guidelines extending therefrom to the surface. These guidelines are used to accurately lower equipment to the template or base, which usually carries a wellhead. Sometimes this lowering operation goes awry and the equipment being lowered can bend or break one of the guide posts. It thus becomes necessary to replace the damaged guide post, preferably remotely from the water surface. This entails releasing the damaged guide post, retrieving it to the surface and installing a new one.

While prior art devices are known in the subsea field for remotely replacing damaged subsea equipment, there is a continuing need to provide a quick, easy and reliable system for removing a damaged guide post by itself and replacing it. Examples of prior work in this field and related work are disclosed in the following U.S. Pat. Nos.: 1,443,455 to Bown; 3,163,220 to Haeber er al.; 3,186,745 to Lyles; 3,321,015 to Word; 3,553,821 to Postlewaite; 3,603,386 to Talley; 3,678,996 to Herd; 3,946,805 to Peterman; and 4,120,362 and 4,194,857 to Chateau et al.

SUMMARY OF THE INVENTION

Accordingly, an object of the invention is to provide a releasable guide post mount for subsea well installations that can remotely and individually release a damaged guide post in a quick, easy and reliable manner from the water surface.

Another object of the invention is to provide a method for recovering a damaged guide post by remote operation from the water surface.

The foregoing objects are basically attained by providing in a guide system for an underwater well installation of the type comprising a base secured to an upstanding well member and at least one guideline to be secured to the base and to extend from the base to the surface of the body of water, the combination comprising a receptacle rigidly secured to the base and having an upwardly opening cavity; a guide post having a lower end portion of shape and dimensions to be accommodated by said cavity, said lower end portion having an outwardly opening locking recess; at least one locking element carried by said receptacle and movable between a first, inactive position, in which the locking element is disengaged from said locking recess when said lower end portion of the guide post is disposed in said cavity, and a second, active position, in which the locking element engages said locking recess to lock the guide post to the receptacle; and a movable operating member carried by said receptacle and movable between a first position, in which the operating member holds said locking element in its active position, and a second position, in which the movable operating member at least frees said locking element for movement to its inactive position, said movable operating member being externally exposed for engagement by a remotely operated tool.

These objects are also attained by following the method for installing and remotely recovering a guide post of an underwater well installation, comprising the steps of connecting the guide post to a guide means base by a mount comprising a guide post locking device including an external member movable from a first, locked position, in which the locking device secures the guide post to the base, and a second, released position, in which the guide post is free for upward removal; lowering to the underwater well installation a remotely operated tool; operating the tool to move the external movable member from its first position to its second position; and then operating the tool to recover the released guide post.

Other objects, advantages and salient features of the invention will become apparent from the following detailed description, which, taken in conjunction with the annexed drawings, discloses a preferred embodiment of the invention.

IDENTIFICATION OF THE DRAWINGS

Referring now to the drawings which form a part of this original disclosure:

FIG. 4 is a transverse cross-sectional view taken generally on line 4—4 in FIG. 2, with FIGS. 2 and 3 being enlarged relative to FIG. 1 and with FIG. 4 being further enlarged;

FIG. 5 is a perspective view of one of the locking elements employed in the device shown in FIGS. 2 and 3;

FIG. 6 is a perspective view illustrating a remotely operated tool that can be used to release the locking device and then recover the guide post; and FIG. 7 is a vertical sectional view of the upper and lower tubes in the tool showing a shear bolt thereon and the flanges in the tubes.

DETAILED DESCRIPTION OF THE INVENTION

Figure 1:
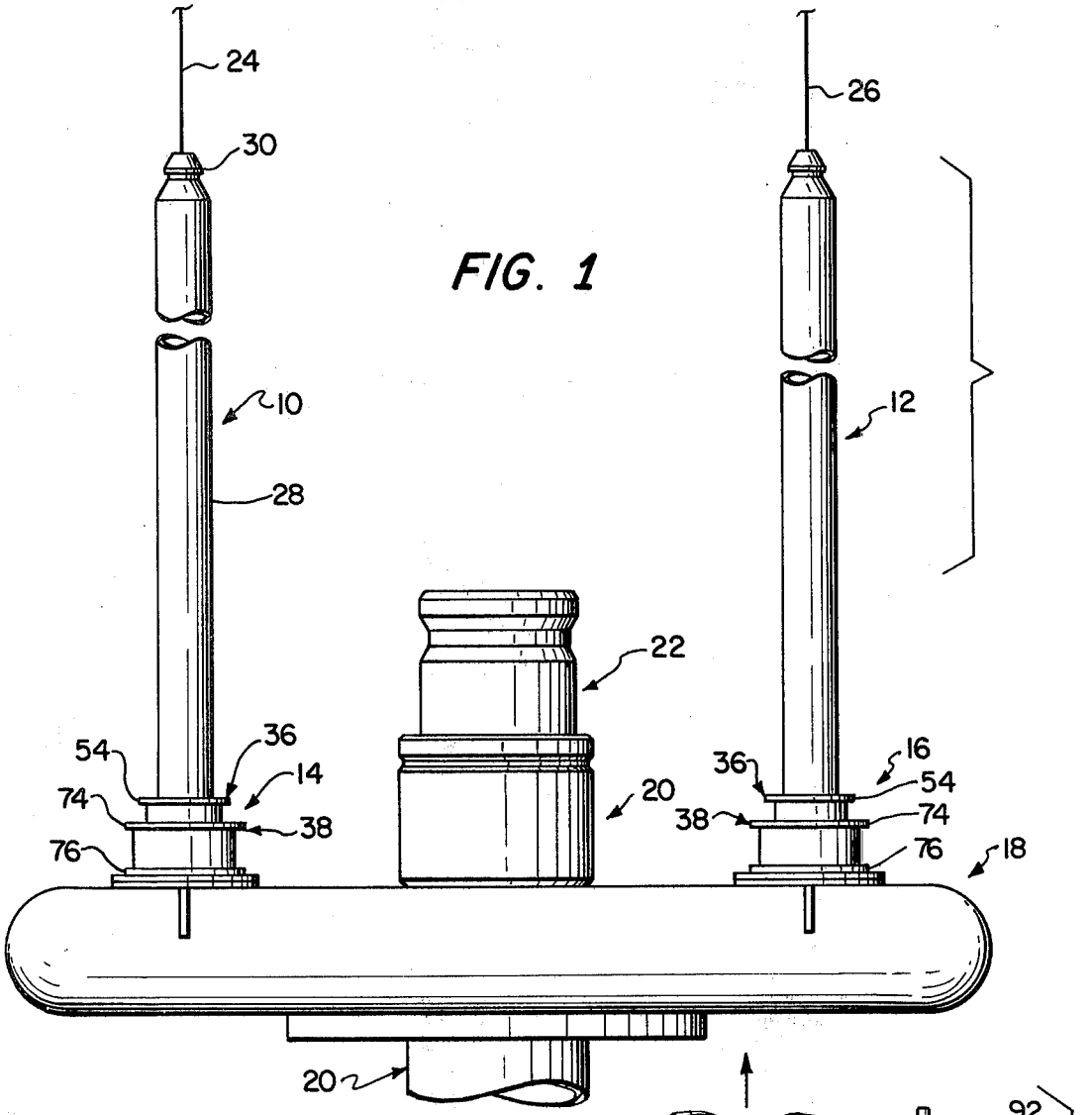
FIG. 1 is a side elevational view of a base, landed and latched to a suspension joint, the base being equipped with guide posts according to the invention.

As seen in FIGS. 1–5, a pair of guide posts 10 and 12 are supported by a pair of releasable guide post mounts 14 and 16, which are in turn supported on a template or guide means base 18. The base is suitably coupled to a suspension joint 20, which is received in the seabed, and a wellhead 22 is coupled to this joint. A pair of guidelines 24 and 26 extend upwardly from the guide posts to the water surface for lowering components or equipment to the wellhead and base. While only two guide posts and guidelines are shown, typically four posts and lines are used with each wellhead, these being arranged in a rectangular array.

The purpose of the guide post mounts is to releasably couple the guide posts to the base 18 for removal in case of damage.

As seen in FIGS. 1–4, a guide post 10, for example, comprises a main tubular body portion 28, an upper male connector 30 at the top, and a lower end portion 32 rigidly secured at the bottom and having a frustoconical bottom surface 33 and an annular, outwardly facing recess in the form of a locking groove having a triangular cross section. In the locked position shown in FIG. 2, the bottom of the lower end portion 32 engages the base 18.

Figure 2:
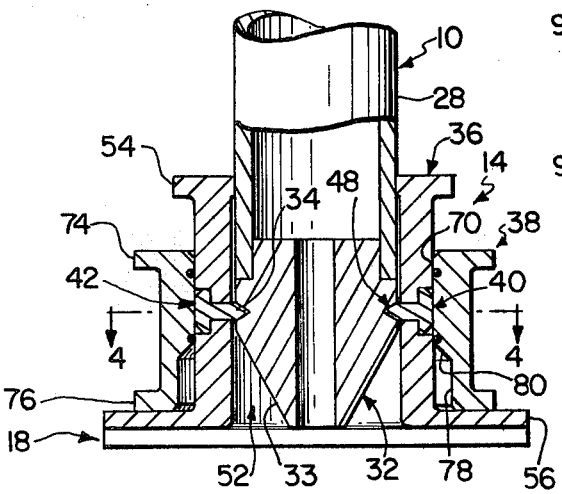
FIG. 2 is a fragmentary vertical sectional view of one of the releasable guide post mounts employed in the apparatus of FIG. 1, showing the guide post locked to the base by a remotely operated locking device.
Figure 3:
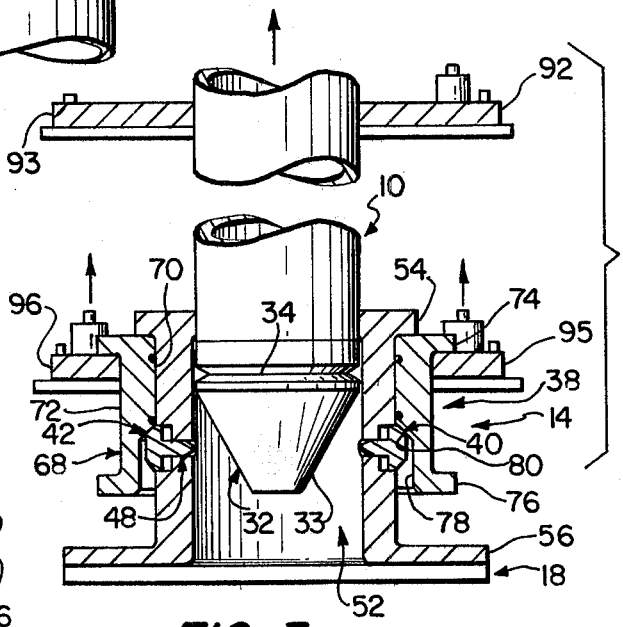
FIG. 3 is a view similar to FIG. 2 but with the guide post shown in side elevation and in the process of being removed after release of the locking device.

The releasable guide post mount 14 is in the locked position in FIGS. 1, 2 and 4, thereby rigidly coupling the guide post to the base, and is in the unlocked position in FIG. 3, thereby allowing the guide post to be raised from the base.

The guide post mount 14, for example, comprises a receptacle 36 rigidly coupled to the base 18, an operating member 38 slidably supported on the receptacle, and a plurality of locking elements 40–43 received in the receptacle and actuated by the operating member to lock the guide post 10 to the mount 14. Operating member 38 and locking elements 40–43 comprise a locking device for the guide posts.

Each of the locking elements is the same and as shown in FIG. 5 element 42, for example, comprises a ring segment 44 having an upwardly and inwardly tapering surface 45 on the top of its outer surface and a downwardly and inwardly tapering surface 46 on the bottom of its outer surface, and a cylindrical pin 48 extending from the center of the ring segment and having a frustoconical tapering end 50.

The receptacle 36 is in the form of a cylindrical support sleeve defining a cylindrical cavity 52 with an upwardly opening top end for receiving the lower end portion 32 of the guide post therein. As seen in FIGS. 2 and 3, the outer diameters of the guide post tubular body portion 28 and lower end portion 32 are equal and are slightly smaller than the inner diameter of the cylindrical cavity 52. The receptacle has a radially outwardly directed flange 54 at the top and a radially outwardly directed flange 56 at the bottom, these flanges being annular and flange 56 being rigidly coupled to the base 18. A set of four cylindrical through-bores 58–61 are formed horizontally through the wall of the receptacle at 90 degree intervals at a height above the base 18 so that they align with the locking groove 34 when the guide post is bottomed-out on the base as seen in FIG. 2.

These through-bores slidably receive pins 48 on the locking elements therein as seen in FIGS. 2–4.

A set of four horizontally oriented, arcuate recesses 64–67 are formed in the outer cylindrical surface of the receptacle 36, each in alignment with one of the through-bores 58–61 and receiving a locking element ring segment therein. Each recess has a radial depth substantially equal to the radial thickness of the ring segment on each of the locking elements 40–43. The overall thickness of the receptacle 36 wall is such that the pins 48 in each locking element extend into the cavity 52, and thereby into the locking groove 34 in the guide post, when the ring segments 44 are fully received in the recesses 64–67 in the receptacle, as seen in FIGS. 2 and 4.

As seen specifically in FIGS. 2–4, the operating member, or actuating sleeve, 38 comprises a main tubular sleeve 68 having a cylindrical inner surface 70 and a cylindrical outer surface 72, a radially outwardly directed annular flange 74 at the top and a radially outwardly directed annular flange 76 at the bottom. The inner diameter of inner surface 70 is slightly larger than and is received about the outer diameter of receptacle 36 so the operating member is slidably supported by the receptacle for longitudinal movement between radial flanges 54 and 56 of the receptacle, the longitudinal length of the operating member being smaller than the distance between the flanges 54 and 56.

The inner cylindrical surface 70 of the operating member has an enlarged diameter cylindrical bore 78 at the bottom with an upwardly and inwardly tapering frustoconical surface 80 in between surfaces 70 and bore 78, as seen is FIGS. 2 and 3. This frustoconical surface 80 tapers at substantially the same angle as the taper on upper tapering surface 45 on each locking element ring segment 44 and is aligned and in engagement with such tapering surfaces when the locking elements are fully retracted radially outwardly and the operating member 38 abuts flange 54 of the receptacle as seen in FIG. 3.

RELEASING THE GUIDE POST

Referring to FIG. 2, the guide post 10 is seen locked to the guide post mount 14 since pins 48 on the locking elements are in their second, active positions received in the through-bores in the receptacle and in the locking groove 34 in the guide post, and since operating member 38 prevents outward movement of the locking elements, the ring segments thereof being in contact with inner surface 70 of the operating member, which is in its first, locked position.

To release the guide post, operating member 38 is moved upwardly from its first, locking position shown in FIG. 2 to its second, unlocking or released position shown in FIG. 3 until the operating member abuts flange 54 on the receptacle 36. At this time, an upward force on the guide post 10 causes the bottom surface on the triangular cross section of the locking groove 34 to cam the locking elements radially outwardly by camming against the tapered ends 50 of the pins 48 on the locking elements. The locking elements can move radially outwardly to their first, inactive position since they are aligned with frustoconical surface 80 and enlarged bore 78 in the operating member, as seen in FIG. 3.

Once the damaged guide post is removed, a new one can be installed into the releasable guide mount 14 by a reversal of these steps, the frustoconical surface 80 on the operating member camming the locking elements radially inwardly by acting on tapering surefaces 45 thereon.

REMOTELY OPERATED TOOL

A typical tool 84 for remotely releasing a damaged guide post is shown in FIGS. 6 and 7.

The general operation of this tool comprises lowering the tool down the guidelines on the undamaged guide posts, clamping the tool onto the operating member 38, pulling the tool up to in turn pull up the operating member to the position shown in FIG. 3 (thereby unlocking the guide post), clamping the tool onto the damaged guide post and pulling the tool upwardly, unclamping the operating member, and then retrieving the tool with the guide post clamped thereto to the surface.

The tool 84 comprises an upper tube 86, a lower tube, 88 telescoped into the upper tube, an upper plate 90 carrying a pair of clamping jaws 92 and 93, a lower plate 94 carrying a pair of clamping jaws 95 and 96, a pair of arms 98 and 100 coupled to the upper tube and having shackles 102 and 104 at the ends for receiving the guidelines 24 and 27 on undamaged guide posts, assuming with reference to FIG. 1 that guide post 12 is the damaged one and that guideline 27 extends from another guide post (not shown) behind guide post 12.

As seen in FIG. 7, upper tube 86 has a radially inwardly directed annular flange 106 slidably receiving the outer surface of the lower tube and the lower tube 88 has a radially outwardly directed annular flange 108 slidably receiving the inner surface of the upper tube. This combination forms a slip-joint between the tubes which is temporarily maintained in the expanded position shown in FIG. 7 by a shear bolt 110 received in the wall of the upper tube and engaging the bottom of the flange 108 on the inner tube.

The tool 84 is remotely lowering from the surface by a lowering line 112 coupled to the upper tube 86 by an eye bolt 114.

Plates 90 and 94 are rigidly coupled, respectively, to upper tube 86 and lower tube 88 and each carries two double-acting hydraulic cylinders and piston rods for opening and closing the jaws 92, 93, 95 and 96. On the upper plate 90 hydraulic cylinders 116 and 117 are rigidly coupled thereto and have piston rods 118 and 119 extending therefrom which are pivotally coupled to jaws 92 and 93 by pins 120 and 121. Each of the jaws is pivotally coupled to the plate by pins 122 and 123. Semicircular cut-outs 124 and 125 are formed on the inner sides of the jaws for receiving a guide post therein. Hydraulic fluid is supplied to the cylinders through suitable hydraulic lines, not shown.

The lower plate 94 has a similar set of cylinders 126 and 127, piston rods 128 and 129, pins 130 and 131, pins 132 and 133, and cut-outs 134 and 135 in jaws 95 and 96. These cut-outs have larger radii than cut-outs 124 and 125 since they will be engaging the operating member 38, which has a larger outer diameter than the outer diameter of the guide post.

If desired, a second set of upper jaws can be used to more securely grasp the damaged guide post on removal thereof.

REMOTE OPERATION OF THE TOOL

In operation, assuming a damaged guide post is locked in a guide post mount as shown in FIGS. 1 and 2, the tool 84 is lowered to the damaged guide post from the surface using lowering line 112, with the shackles 102 and 104 receiving the guidelines 24 and 27 for alignment purposes. The tool is lowered with the upper and lower jaws open.

When the tool reaches the guide post mount, lower jaws 95 and 96 are closed by actuation of hydraulic cylinders 126 and 127 around operating member 38 between its upper and lower flanges 74 and 76.

Thus, the tool 84 is pulled up slightly, which results in the jaws 95 and 96 sliding along the outer surface 72 of the operating member, then abutting the upper flange 74 and pulling the operating member up against the flange 54 on the receptacle 36 from the position shown in FIG. 2 to that shown in FIG. 3. This unlocks the locking elements from the restraint of the operating member, but still leaves the guide post in the receptacle.

Thus, the next step is to close the upper jaws 92 and 93 around the guide post by actuation of hydraulic cylinders 116 and 117, and then pulling the tool 84 upwardly. This upward pulling breaks shear bolt 110 and allows the upper tube 86 to move upwardly a few inches, carrying the guide post out of the receptacle. The lower jaws 95 and 96 are then opened, releasing the tool from the mount. The entire tool with the damaged guide post is now retrieved to the surface.

To install a new guide post, tool 84 can be used with slight modification including two sets of upper jaws and a rigid, unbreakable connection between the upper and lower tubes.

The operation would include supporting the new guide post vertically on the two sets of closed upper jaws, lowering the tool to the base 18 with the lower jaws open, closing the jaws around the operating member, pulling the tool up to move the operating member up to an unlocking position shown in FIG. 3, releasing the upper jaws to allow the guide post to slide downwardly into the receptacle, lowering the tool to lower the operating member into its locking position shown in FIG. 2, opening the lower jaws, and retrieving the tool to the surface.

While one advantageous embodiment has been chosen to illustrate the invention, it will be understood by those skilled in the art that various changes and modifications can be made therein without departing from the scope of the invention as defined in the appended claims.

What is claimed is:

1. In a guide system for an underwater well installation of the type comprising a base secured to an upstanding well member and at least one guideline to be secured to the base and to extend from the base to the surface of the body of water, the combination comprising:

a receptacle rigidly secured to the base and having an upwardly opening cavity;

a guide post having a lower end portion of shape and dimensions to be accommodated by said cavity, said lower end portion having an outwardly opening locking recess;

at least one locking element carried by said receptacle and movable between a first, inactive position, in which the locking element is disengaged from said locking recess when said lower end portion of the guide post is disposed in said cavity, and a second, active position, in which the locking element engages said locking recess to lock the guide post to the receptacle; and a movable operating member carried by said receptacle and movable between a first position, in which the operating member holds said locking element in its active position, and a second position, in which the movable operating member at least frees said locking element for movement to its inactive position, said operating member having externally exposed means for direct engagement by a remotely lowered and remotely operated tool.

2. A guide system according to claim 1, wherein said receptacle comprises a sleeve having an upper open end.

3. A guide system according to claim 2, wherein said locking element comprises a ring segment having a pin extending therefrom with a tapered end, said sleeve having a recess receiving said ring segment and a through-bore receiving said pin, said pin tapered end being engageable with said locking recess.

4. A guide system according to claim 2, wherein said operating member comprises an outer sleeve movably supported on said receptacle sleeve.

5. A guide system according to claim 4, wherein said outer sleeve has an inner cylindrical surface, an enlarged cylindrical bore at the bottom and an upwardly and inwardly tapering, frustoconical surface inbetween, said outer sleeve inner cylindrical surface engaging said locking element when in said first position and said outer sleeve frustoconical surface and enlarged cylindrical bore receiving said locking element when in said second position.

6. A guide system according to claim 5, wherein said locking element has an upwardly and inwardly tapering surface at the top for engaging said frustoconical surface on said outer sleeve.

7. A guide system according to claim 1, wherein said receptacle has a radial flange at the top for limiting upward movement of said operating member.

8. A guide system according to claim 1, wherein said operating member has a radial flange at the top for engagement with the remotely operated tool.

9. A guide system according to claim 1, wherein said locking element includes a plurality of pins received in a plurality of radially extending through-bores in said receptacle.

10. A method for installing and remotely recovering a guide post of an underwater well installation, comprising the steps of connecting the guide post to a guide means base by a mount comprising a guide post locking device including an external member movable from a first, locked position, in which the locking device secures the guide post to the base, and a second, released position, in which the guide post is free for upward removal, remotely lowering to the underwater well installation a remotely operated tool, remotely operating the tool to directly engage the external movable member and to move the external movable member from its first position to its second position, and then remotely operating the tool to recover the released guide post.

* * * * *